US005139618A

United States Patent [19]

Garcia Pastor et al.

[11] Patent Number: 5,139,618

[45] Date of Patent: Aug. 18, 1992

[54] CLEANING DEVICE FOR PAPER MACHINE ROLLERS

[76] Inventors: Daniel Garcia Pastor, Burriana 19; Francisco Garcia Pastor, Burriana, both of Valencia, Spain, 46005

[21] Appl. No.: 631,690

[22] Filed: Dec. 21, 1990

[30] Foreign Application Priority Data

Dec. 26, 1989 [ES] Spain ..... 8904367

[51] Int. Cl.[5] ..... D21G 3/00

[52] U.S. Cl. ..... 162/276; 15/256.51; 162/281

[58] Field of Search ..... 162/275, 276, 281; 15/256.51

[56] References Cited

U.S. PATENT DOCUMENTS 4,080,059 3/1978 Tani et al. ..... 15/256.51
5,032,229 7/1991 Boucher ..... 162/281

FOREIGN PATENT DOCUMENTS 1051628 2/1959 Fed. Rep. of Germany ..... 162/281
1222732 4/1986 U.S.S.R. ..... 162/281

*Primary Examiner*—Karen M. Hastings
*Attorney, Agent, or Firm*—Darby & Darby

[57] ABSTRACT

The device consists of a scraper consisting of a unit of two parallel blades (1) and (2) that diagonally incide on the surface of the roller or cylinder.

The separation space forms a forced water circulation chamber with inlets (7) and outlets (8) that cool and lubricate the blades and clean away impurities.

2 Claims, 4 Drawing Sheets

CLEANING DEVICE FOR PAPER MACHINE ROLLERS

OBJECT OF THE INVENTION

The object of the invention, as is expressed in the title of the present specification, is a cleaning device for paper machine rollers whose specific purpose is to keep perfectly clean the surface of rollers or cylinders of the machines.

BACKGROUND OF THE INVENTION

In the paper industry, specifically paper machines, there is commonly used equipment: scraper or blade which is to clean the surface of the rollers or rotating cylinders.

These rollers, in a paper machine, contain under this name, a broad range of uses, in other words: guide rollers pressure (aspirating or non-aspirating) rollers, dryer rollers, glazing rollers, smoothing rollers, etc.

It is normal that a sheet of paper in contact with the bare surface of a roller transmits to it particles of its material content (fibers, fillers, etc.) caused by the adhesion of the sheet to the surface, whose result is the soiling of the same and the undesired increase of adhesion. The way to avoid it is to place a scraper that eliminates said adherences to keep the surface clean and to avoid in the progression thereof the sticking phenomenon of the sheet.

A commonly used solution consists of placing a lubrication sprinkler before the contact of the scraper sheet for the purpose of cooling and lubricating the contact area between the scraper and the roller. It is obvious to point out that the material of the scraper as well as that of the roller or its covering have a diverse composition, according to the function or use in the paper making process.

DESCRIPTION OF THE INVENTION

The technology developed by the invention is directed towards optimizing the cleaning process of the surface of the rollers, combining in a single unit the functions of scraping, cooling and lubricating.

The invention consists of forming the scraper by a unit of two cleaning sheets or blades, placed parallel and with a sufficient separation between them to form a chamber a forced water circulation through which provides for cooling, lubricating of the blades and eliminating of residue.

The unit of blades will be applied upon rollers in as many points as necessary, depending on the diameter and they will be supported by rigid or flexible structures depending on the convenience of the case and the adequate shape.

This device means a total innovation based on the following advantages:

A) It effects a double cleaning effect on the surface of the roller to which it is applied.

B) The water which circulates through the chamber between the blades constantly cools the blades, at the same time that it effects a hydraulic scavenging upon the surface of the roller or cylinder cleaning away the impurities deposited on them.

C) The impurities that have not been cleaned away by the first blade, due to the high adherence to the surface of the cylinder are hydrated and predisposed to an easier separation by the second blade.

D) The water is dosed continuously and in the exact amount that the roller itself determines, by means of inner pressure of the water and the pressure exerted from the support of the device.

BRIEF DESCRIPTION OF THE DRAWINGS

For a better understanding of the above, the present specification is accompanied by several drawings, in which the following has been represented.

DESCRIPTION OF A PREFERRED EMBODIMENT

Figure 1:
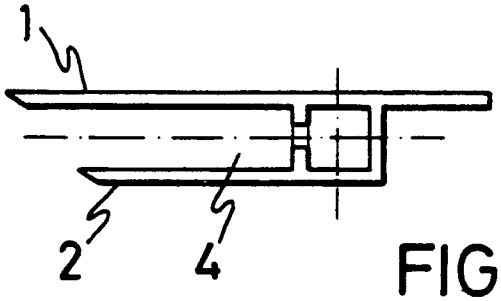
FIG. 1—Profile of the scraper device

In accordance with the referred to drawings, one can see that the device comprises a set of two blades (1) and (2), arranged parallel, with a different length for placement thereof in position of attack on the surface of the roller or cylinder (3).

The space comprised between both blades constitutes a forced water circulation chamber (4) that facilitates cleaning away of the impurities at the same time that it cools and lubricates the blades.

The lateral ends of the chamber are closed with seals (5) and (6) and the water inlet (7) and outlet (8) ducts pass through them.

Figure 2:
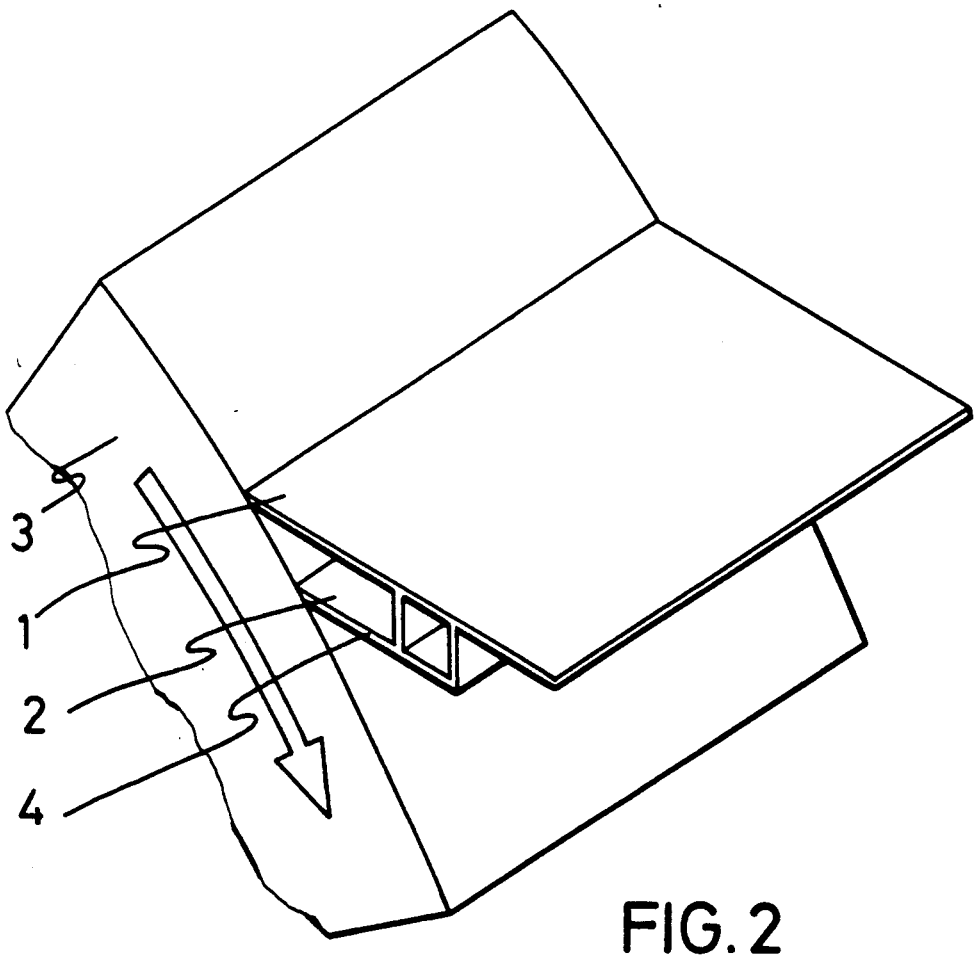
FIG. 2—The above figure ready to act upon a roller or cylinder.
Figure 3:
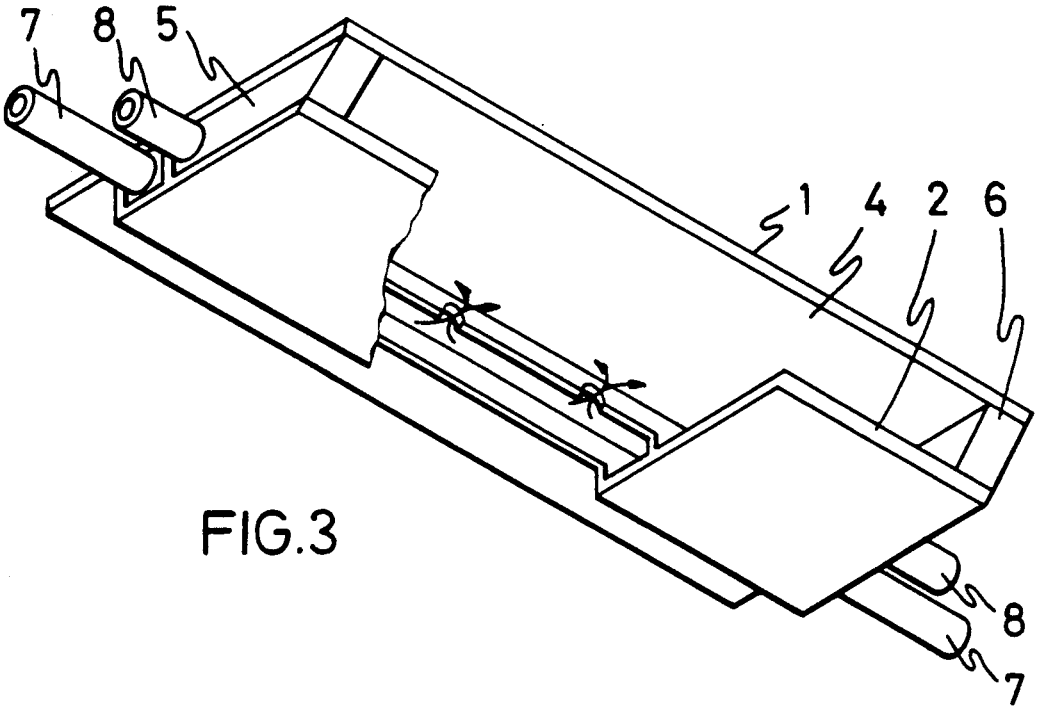
FIG. 3—Perspective view of the device in which the retainers that seal the central water chamber are shown.
Figure 4:
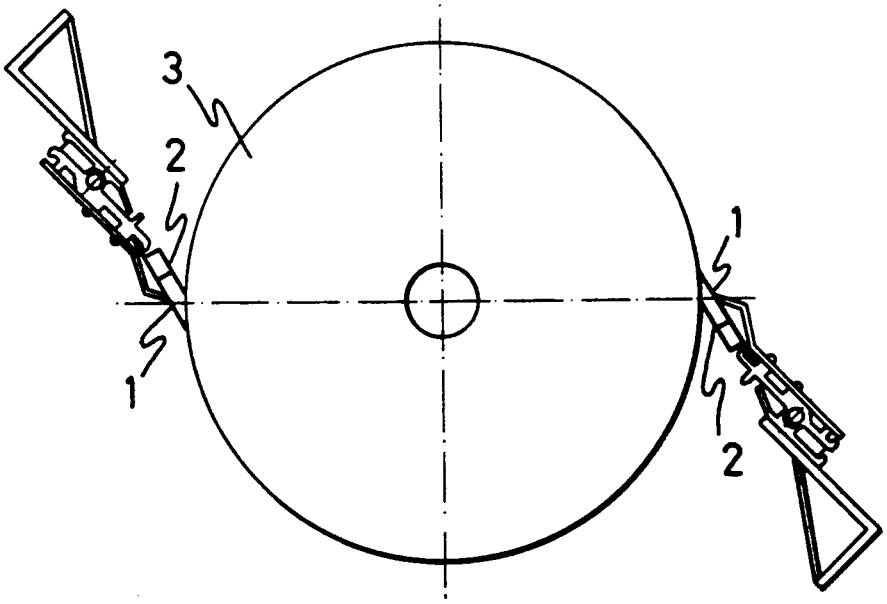
FIGS. 4, 5 and 6—Several examples of arrangement of the device, in variable number, upon a roller or cylinder in accordance with the convenience of use, depending on the diameter.
Figure 5:
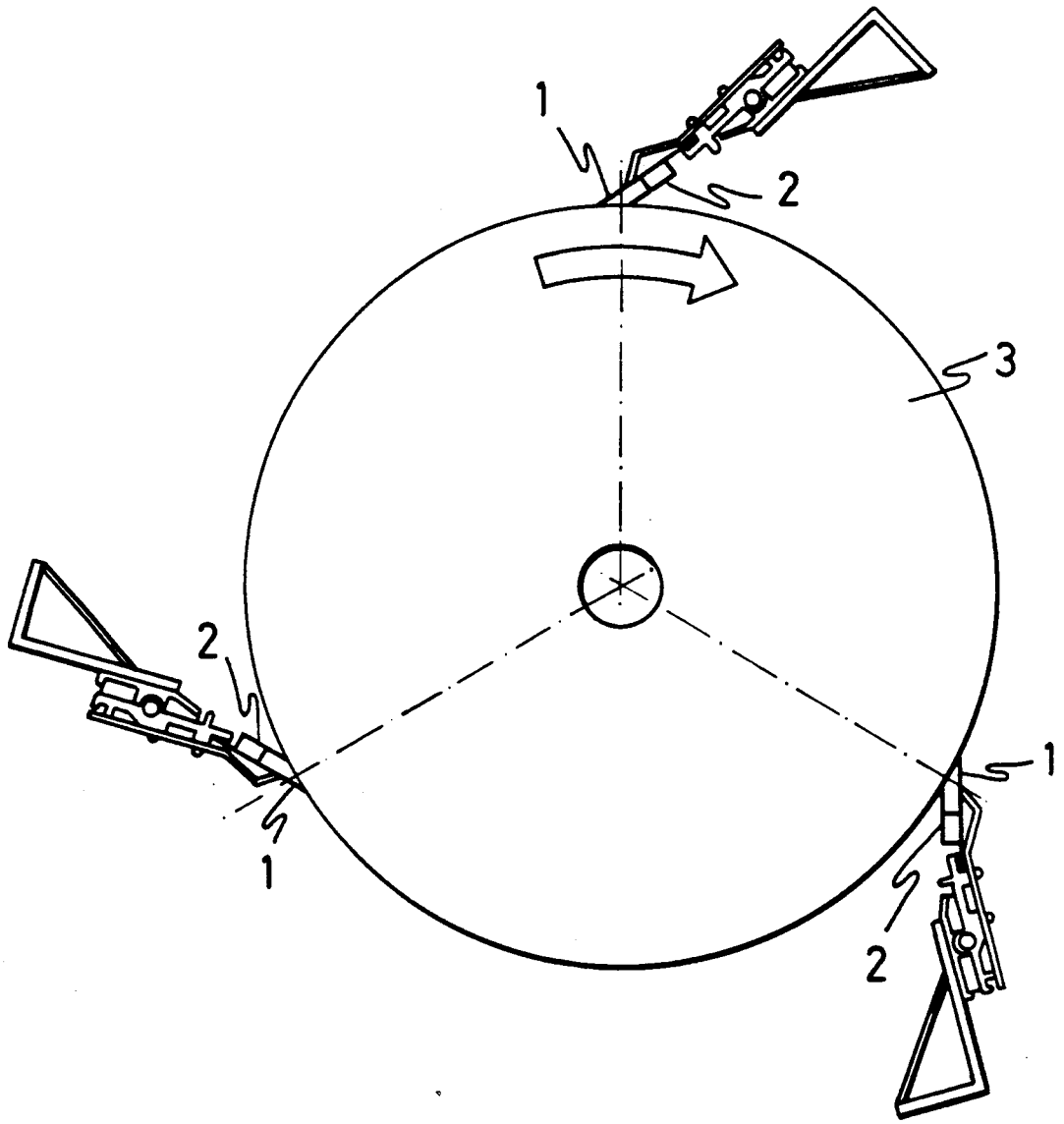
Figure 6:
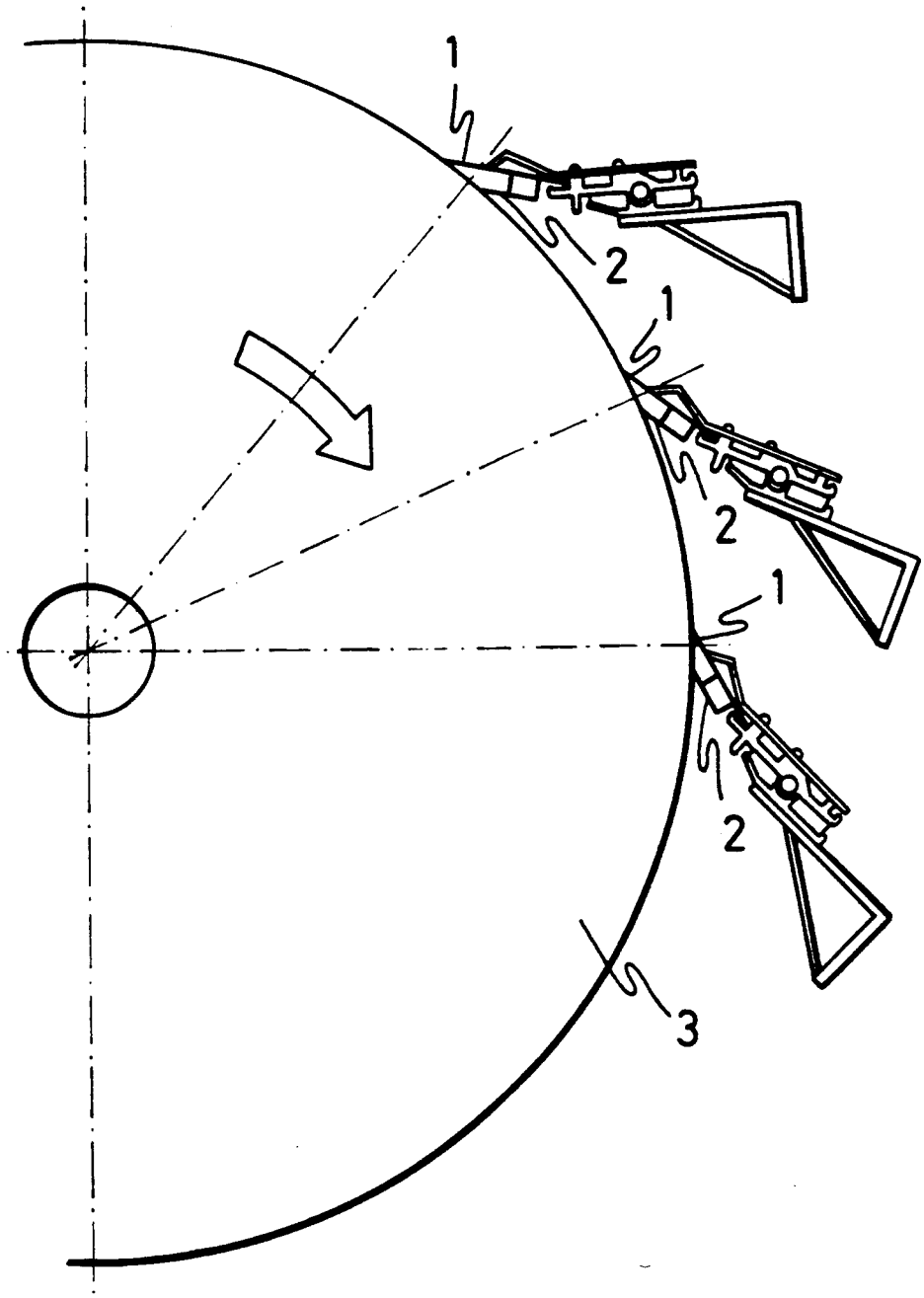

During cleaning, the portion of the surface of the roller (3) between blades (1 and 2) closes the water circulation chamber (4), as is shown in FIGS. 2 and 4. As a result of forced water circulation into the chamber (4) through the water inlet duct (7) and out of the water outlet duct (8), impurities are carried out from the chamber (4).

This device is useable upon any type of rotating rollers and applicable in a variable number upon any support and in any work position, as long as the blades are adequately positioned.

We claim:

1. A device for cleaning a paper machine roller, comprising:

scraper means for engaging the surface of the roller, including a pair of spaced blades, each having opposite lateral edges and a roller engaging edge;

sealing means extending between said blades at each of said lateral edges, respectively, for defining a closed circulation chamber in cooperation with said blades and the roller, said circulation chamber being closed by a surface portion of the roller extending between said roller engaging edges of said blades when said scraper means contacts the surface of the roller; and means defining inlet and outlet passages extending through said sealing means to said circulation chamber for supplying a liquid flow into said circulation chamber to cool and lubricate said blades, to clean the surface of the roller and to remove impurities from said circulation chamber by said liquid flow.

2. A cleaning device as set forth in claim 1 wherein said inlet and outlet passage defining means comprising inlet and outlet ducts extending to said circulation chamber.

* * * * *